US010059898B2

(12) United States Patent
Han

(10) Patent No.: US 10,059,898 B2
(45) Date of Patent: Aug. 28, 2018

(54) HIGH-VISCOSITY METALLOCENE POLYALPHA-OLEFINS WITH HIGH ELECTROHYDRODYNAMIC PERFORMANCE

(71) Applicant: ExxonMobil Chemical Patents Inc., Baytown, TX (US)

(72) Inventor: Wenning W. Han, Houston, TX (US)

(73) Assignee: ExxonMobil Chemical Patents Inc., Baytown, TX (US)

( * ) Notice: Subject to any disclaimer, the term of this patent is extended or adjusted under 35 U.S.C. 154(b) by 7 days.

(21) Appl. No.: 15/166,615

(22) Filed: May 27, 2016

(65) Prior Publication Data

US 2017/0051223 A1 Feb. 23, 2017

Related U.S. Application Data

(60) Provisional application No. 62/241,843, filed on Oct. 15, 2015, provisional application No. 62/208,473, filed on Aug. 21, 2015.

(30) Foreign Application Priority Data

Sep. 29, 2015 (EP) ..... 15187365
Dec. 28, 2015 (EP) ..... 15202778

(51) Int. Cl.
*C07F 5/04* (2006.01)
*C10M 105/04* (2006.01)
*C10M 107/10* (2006.01)

(52) U.S. Cl.
CPC ..... *C10M 105/04* (2013.01); *C10M 107/10* (2013.01); *C10M 2203/024* (2013.01);
(Continued)

(58) Field of Classification Search
CPC ..... C10M 2203/024; C10N 2230/02; C10N 2240/04
(Continued)

(56) References Cited

U.S. PATENT DOCUMENTS 4,827,064 A 5/1989 Wu
4,827,073 A 5/1989 Wu
(Continued)

FOREIGN PATENT DOCUMENTS

EP 1661921 5/2006
EP 1043341 10/2008
(Continued)

OTHER PUBLICATIONS

Ewen et al., "Stereoblock Isotactic-Hemiisotatctic Poly(propylene)s and Ethylene/Propylene Copolymers Obtained with ansa-Cyclopenta[1,2-b;4,3-b']dithiophene Catalysts", Macromolecular Chemistry and Physics (2004), 205, pp. 302-307.
(Continued)

*Primary Examiner* — Vishal Vasisth
(74) *Attorney, Agent, or Firm* — Siwen Chen

(57) ABSTRACT

A PAO lubricant base stock having a KV100 of at least 200 cSt and comprising multiple PAO molecules comprising at least 200 carbon atoms per molecule, wherein each of the PAO molecules comprises multiple pendant groups; and the average pendant group length of all the pendant groups excluding one methyl on each of the PAO molecules among at least 90 mol % of all of the PAO molecules, if one or more methyl is present, is at least 6.0. The PAO base stock exhibits high EHL thicknesses at 40° C., 80° C., and 120° C., rendering it particularly useful in lubricant compositions experiencing high-stress events such as gear oils, automotive transmission oils, and the like.

25 Claims, 7 Drawing Sheets

(52) U.S. Cl.
CPC ..... *C10M 2205/0285* (2013.01); *C10N 2220/022* (2013.01); *C10N 2220/028* (2013.01); *C10N 2230/02* (2013.01); *C10N 2240/04* (2013.01)

(58) Field of Classification Search
USPC ..... 508/200
See application file for complete search history.

(56) References Cited

U.S. PATENT DOCUMENTS

| | | | |
|---|---|---|---|
| 4,914,254 | A | 4/1990 | Pelrine |
| 4,926,004 | A | 5/1990 | Pelrine |
| 4,967,032 | A | 10/1990 | Ho et al. |
| 6,706,828 | B2 | 3/2004 | DiMaio |
| 6,846,778 | B2 | 1/2005 | Johnson et al. |
| 6,858,767 | B1 | 2/2005 | Dimaio et al. |
| 7,019,091 | B2 | 3/2006 | Minami et al. |
| 7,053,254 | B2 | 5/2006 | Miller |
| 7,129,197 | B2 | 10/2006 | Song et al. |
| 7,241,375 | B2 | 7/2007 | Johnson et al. |
| 7,344,631 | B2 | 3/2008 | Bishop et al. |
| 7,589,145 | B2 | 9/2009 | Brant et al. |
| 7,795,194 | B2 | 9/2010 | Iimura et al. |
| 7,880,047 | B2 | 2/2011 | Knowles et al. |
| 8,071,687 | B2 | 12/2011 | Jiang et al. |
| 8,227,392 | B2 | 7/2012 | Wu et al. |
| 8,389,780 | B2 | 3/2013 | Knowles et al. |
| 8,530,712 | B2 | 9/2013 | Wu et al. |
| 8,748,361 | B2 | 6/2014 | Wu et al. |
| 8,816,034 | B2 | 8/2014 | Sato et al. |
| 9,409,834 | B2 | 8/2016 | Wu et al. |
| 2005/0049373 | A1 | 3/2005 | Minami et al. |
| 2008/0042037 | A1 | 2/2008 | Orr |
| 2008/0177121 | A1 | 7/2008 | Wu et al. |
| 2009/0005279 | A1 | 1/2009 | Wu et al. |
| 2009/0036725 | A1 | 2/2009 | Wu et al. |
| 2009/0088355 | A1 | 4/2009 | Hee et al. |
| 2009/0247442 | A1 | 10/2009 | Hagemeister et al. |
| 2010/0087349 | A1 | 4/2010 | Lee et al. |
| 2010/0317904 | A1 | 12/2010 | Small et al. |
| 2010/0323937 | A1 | 12/2010 | Wu et al. |
| 2011/0040052 | A1 | 2/2011 | Bburton et al. |
| 2011/0082061 | A1 | 4/2011 | Carey et al. |
| 2011/0092752 | A1 | 4/2011 | Knowles et al. |
| 2011/0160502 | A1 | 6/2011 | Wu et al. |
| 2012/0302481 | A1 | 11/2012 | Katayama et al. |
| 2013/0023633 | A1 | 1/2013 | Holtcamp et al. |
| 2013/0303818 | A1 | 11/2013 | Inagaki et al. |
| 2014/0087986 | A1 | 3/2014 | Patil et al. |
| 2014/0135461 | A1 | 5/2014 | Kohiruimaki et al. |
| 2014/0235909 | A1 | 8/2014 | Shimizu et al. |
| 2014/0256997 | A1 | 9/2014 | Shimizu et al. |
| 2014/0309151 | A1 | 10/2014 | Shimizu et al. |
| 2015/0099679 | A1 | 4/2015 | Yang et al. |

FOREIGN PATENT DOCUMENTS

| | | | |
|---|---|---|---|
| EP | 2738185 | A | 6/2014 |
| EP | 2746302 | A | 6/2014 |
| EP | 2470571 | | 12/2014 |
| JP | 2005/200450 | | 7/2005 |
| JP | 5357605 | B | 4/2009 |
| JP | 4283120 | B | 6/2009 |
| JP | 2010/065072 | | 3/2010 |
| JP | 2010/070593 | | 4/2010 |
| JP | 5808292 | B | 6/2012 |
| JP | 2013199517 | | 10/2013 |
| JP | 2013199585 | | 10/2013 |
| WO | 2002/14384 | A | 2/2002 |
| WO | 2005121280 | | 12/2005 |
| WO | 2007/011459 | | 1/2007 |
| WO | 2008/042037 | | 4/2008 |
| WO | 2009/017953 | | 2/2009 |
| WO | 2009/123800 | A | 10/2009 |
| WO | 2009148685 | | 12/2009 |
| WO | 2011/019541 | | 2/2011 |
| WO | 2013/055483 | | 4/2013 |
| WO | 2014/065984 | | 3/2014 |
| WO | 2014/065984 | A | 5/2014 |
| WO | 2014209712 | | 12/2014 |
| WO | 2017/034659 | A | 3/2017 |

OTHER PUBLICATIONS

Miller, S.A. "Insertion vs. site epimerization with singly-bridged and doubly-bridged metallocene polymerization catalysts", Journal of Organometallic Chemistry (2007), 692, pp. 4708-4716.

"Industrial Technology of Next Generation Polymer by Metallocene Catalyst," (Reference A) title page, p. 993, and publication data (published May 20, 1995), and alleged partial translation provided by third party law firm, Enclosure 2, dated Oct. 4, 2012, Hoffmann EITLE, Patent—und Rechtsanwalte, 81925 Munchen, Arabellastr. 4.

"Living Polymerization by Homogeneous Transition Metal Catalyst," (Reference B) title page, pp. 46 and 47 and page with publication data (published on May 20, 1999), and alleged partial translation provided by third party law firm, Enclosure 3, dated Oct. 4, 2012, Hoffmann.cndot.EITLE, Patent—und Rechtsanwalte, 81925 Mu {umlaut over (n)}chen, Arabellastr. 4.

E. Riedel, Editor, Walter de Gruvter, Berlin, NY, 1999, Modem Inorganic Chemistry, Title page and pp. 696-697, alleged English translation provided by third party law firm. Hoffman EITLE Patent—und Rechtsanwalte, 81925 Munchen, Arabellastr 4.Enclosure 1dated Oct. 4, 2012.

"New Polymer Produced by Metallocene Catalyst," (Reference C) title page, pp. 53-55 and page with publication data (published on Apr. 20, 1999), and alleged partial translation provided by third party law firm, Enclosure 4, dated Oct. 4, 2012, Hoffmann.cndot. EITLE, Patent—und Rechtsanwalte, 81925 Munchen, Arabellastr. 4.

M.M. Wu, Synthetic Lubricants and High Performance Functional Fluids, Marcel Dekker, book. Mar. 1999, pp. 195-213; Chapter 7. Alkylated Aromatics.

M. Sacchi et al., "Use Of Different Alkoxysilanes As External Donors In MgClrSupported Ziegler-Hatta Catalysts To Obtain Propene/1-Butene Copolymers With Different Microstructure," Macromolecular Chemistry and Physics, 1994, vol. 195, pp. 2805-2816.

Z. Fan et al., "Effect Of Ethoxy- And Methoxysilane Donors In Propene/1-Hexene Copolymerization With High-Yield Supported Ziegler-Hatta Catalysts," Macromolecular Chemistry and Physics, 1994, vol. 195, pp. 3889-3899.

Lappin, "Routes to Alpha-Olefins", Alpha Olefins Applications Handbook, Chapter 3, Edited by G. R. Lappin and J. D. Sauer, Marcel Dekker, Inc., 1989.

Rizvi, "Dispersants", Lubricant Additives: Chemistry and Application, Chapter 5, ed. By Leslie R. Rudnick, p. 143-170.

Sequeira, "Lubricant Base Oil Hydrogen Refining Processes" Lubricant Base Oil and Wax Processing , Chapter 6, by Avilino Sequeira, Jr., Marcel Dekker, Inc., NY, 1994, pp. 119-152.

Han, "Our mPAO platform is expanding: Introducing SpectraSyn EliteTM 300," 2016 China International Lubricants, Base Oils and Additives Conference, Langham Palace, Sep. 19, 2016.

HIGH-VISCOSITY METALLOCENE POLYALPHA-OLEFINS WITH HIGH ELECTROHYDRODYNAMIC PERFORMANCE

CROSS REFERENCE TO RELATED APPLICATIONS

This application claims the benefits of and priorities to U.S. Ser. No. 62/208,473, filed Aug. 21, 2015, and EP 15187365.0, filed Sep. 29, 2015, U.S. Ser. No. 62/241,843, filed Oct. 15, 2015, and EP 15202778.5, filed Dec. 28, 2015, the disclosures of which are incorporated by reference in their entireties.

FIELD

The present invention relates to polyalpha-olefins (PAO) materials. In particular, the present invention relates to PAO materials having high viscosity and high electrohydrodynamic performance useful as base stocks for lubricants.

BACKGROUND

Lubricants in commercial use today are prepared from a variety of natural and synthetic base stocks admixed with various additive packages and solvents depending upon their intended application. The base stocks can include, e.g., Groups I, II and III mineral oils, gas-to-liquid base oils (GTL), Group IV polyalpha-olefins (PAO) including but not limited to PAOs made by using metallocene catalysts (mPAOs), Group V alkylated aromatics (AA) which include but are not limited to alkylated naphthalenes (ANs), silicone oils, phosphate esters, diesters, polyol esters, and the like.

Manufacturers and users of lubricating compositions desire to improve performance by extending oil drain life of the lubricating composition. Extended drain life is a highly desirable marketing feature of lubricating compositions, especially Group IV/Group V lubricating compositions.

Between machine elements, a thin film of lubricant wedges itself between the would-be contacting surfaces, thereby inhibiting metal-to-metal contact. In electrohydrodynamic lubrication (EHL) conditions, the contact pressures are so high that formation of such film wedge is extremely difficult.

Component in a formulation, typically with higher viscosity, that can provide good EHL film thickness is sought after for that will benefit the lubricant performance in EHL condition. However, the EHL film thickness of a family of molecular structure, typically, increases with increased molecular size, i.e. with increased viscosity at the given operating temperature. But in a given formulation classification, commonly with required final viscosity range, the amount of high viscosity material used must decrease with its viscosity increase following the blending rules. In addition, increase of the viscosity of the high viscosity component and/or increase the high viscosity component treat rate often means that the low temperature performance of the formulation must carry a debit. The formulators must find a balance considering these effects when evaluating a high viscosity component.

Therefore, there is a need of a high viscosity lubricant base stock with desired EHL performance.

SUMMARY

It has been found, in a surprising manner, that a PAO lubricant base stock, especially a mPAO base stock, having a KV100 of at least 200 and a high average pendant group length exhibits a high EHL film thickness at desired temperatures such 40° C., 80° C., and 120° C., rendering them particularly suitable for lubricants operating under high stress conditions, such as gear box lubricants, automotive transmission fluids, differential fluids, and the like.

Thus, a first aspect of the present invention relates to a PAO base stock having a KV100 of at least 200 cSt and comprising multiple PAO molecules comprising at least 200 carbon atoms per molecule, wherein: each PAO molecule comprises multiple pendant groups; and the average pendant group length of all the pendant groups of each PAO molecule among at least 90 mol % of the PAO molecules is at least 6.0.

A second aspect of the present invention relates to a PAO base stock having a KV100 of at least 200 cSt and comprising multiple PAO molecules comprising at least 200 carbon atoms per molecule, wherein the PAO molecules comprise structural units derived from C8-C20 monomers and are produced by using a metallocene catalyst.

A third aspect of the present invention relates to lubricants comprising the PAO lubricant base stock according to the first and second aspects above.

DETAILED DESCRIPTION

Figure 1:
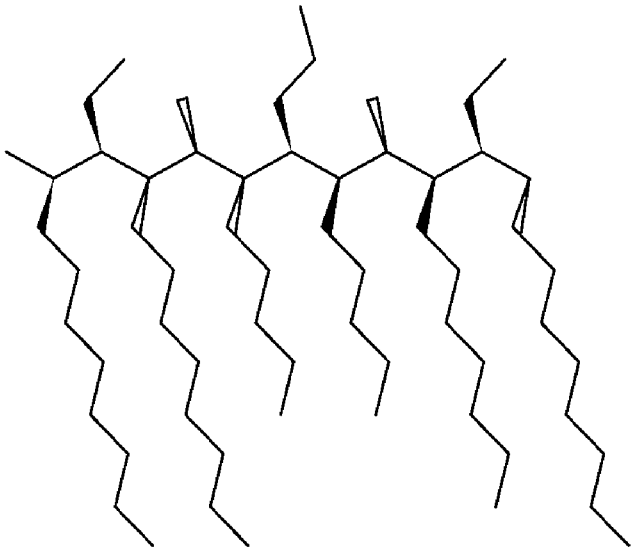
FIG. 1 is a molecular structure of a typical conventional PAO (cPAO) made from linear alpha olefins (LAO) monomers by using a Lewis acid as a catalyst.

All fluid "viscosities" described herein, unless specified, refer to the 100° C. kinematic viscosities in centistokes ("cSt") measured according to ASTM D445 100° C. ("KV100"). All viscosity index ("VI") values are measured according to ASTM D2270.

As used herein, a "lubricant" refers to a substance that can be introduced between two or more moving surfaces and lowers the level of friction between two adjacent surfaces moving relative to each other. A lubricant "base stock" is a material, typically a fluid at the operating temperature of the lubricant, used to formulate a lubricant by admixing with other components. Non-limiting examples of base stocks suitable in lubricants include API Group I, Group II, Group III, Group IV, Group V and Group VI base stocks. Fluids derived from Fischer-Tropsch process or Gas-to-Liquid ("GTL") processes are examples of synthetic base stocks useful for making modern lubricants. GTL base stocks and processes for making them can be found in, e.g., WO2005121280 A1 and U.S. Pat. Nos. 7,344,631; 6,846,778; 7,241,375; and 7,053,254.

In the present disclosure, all percentages of pendant groups are by mole, unless specified otherwise.

The PAO Base Stock

PAOs are oligomeric or polymeric molecules produced from the polymerization reactions of alpha-olefin monomer molecules in the presence of a catalyst system, optionally further hydrogenated to remove residual carbon-carbon double bonds therein. Each PAO molecule has a straight carbon chain with the largest number of carbon atoms, which is designated the carbon backbone of the molecule. Any group attached to the carbon backbone other than to the carbon atoms at the very ends thereof is defined as a pendant group. The number of carbon atoms in the longest straight carbon chain in each pendant group is defined as the length of the pendant group. The backbone typically comprises the carbon atoms derived from the carbon-carbon double bonds in the monomer molecules participating in the polymerization reactions, and additional carbon atoms from monomer molecules that form the two ends of the backbone. A typical, hydrogenated PAO molecule can be represented by the following formula (F-1):

(F-1)

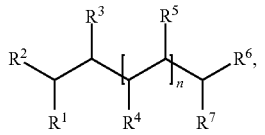

where $R^1$, $R^2$, $R^3$, each of $R^4$ and $R^5$, $R^6$, and $R^7$, the same or different at each occurrence, independently represents a hydrogen or a substituted or unsubstituted hydrocarbyl (preferably an alkyl) group, and n is an non-negative integer corresponding to the degree of polymerization.

Thus, where n=0, (F-1) represents a dimer produced from the reaction of two monomer molecules after a single addition reaction between two carbon-carbon double bonds.

Where n=m, m being a positive integer, (F-1) represents a molecule produced from the reactions of m+2 monomer molecules after m steps of addition reactions between two carbon-carbon double bonds.

Thus, where n=1, (F-1) represents a trimer produced from the reactions of three monomer molecules after two steps of addition reactions between two carbon-carbon double bonds.

Assuming a straight carbon chain starting from $R^1$ and ending with $R^7$ has the largest number of carbon atoms among all straight carbon chain existing in (F-1), that straight carbon chain starting from $R^1$ and ending with $R^7$ having the largest number of carbon atoms constitutes the carbon backbone of the PAO molecule (F-1). $R^2$, $R^3$, each of $R^4$ and $R^5$, and $R^6$, which can be substituted or unsubstituted hydrocarbyl (preferably alkyl) groups, are pendant groups (if not hydrogen).

If only alpha-olefin monomers are used in the polymerization process, and no isomerization of the monomers and oligomers ever occurs in the reaction system during polymerization, about half of $R^1$, $R^2$, $R^3$, all $R^4$ and $R^5$, $R^6$, and $R^7$ would be hydrogen, and one of $R^1$, $R^2$, $R^6$, and $R^7$ would be a methyl, and about half of groups $R^1$, $R^2$, $R^3$, all $R^4$ and $R^5$, $R^6$, and $R^7$ would be hydrocarbyl groups introduced from the alpha-olefin monomer molecules. In a specific example of such case, assuming $R^2$ is methyl, $R^3$, all $R^5$, and $R^6$ are hydrogen, and $R^1$, all $R^4$, and $R^7$ have 8 carbon atoms in the longest carbon chains contained therein, and n=8, then the carbon backbone of the (F-1) PAO molecule would comprise 35 carbon atoms, and the average pendant group length of the pendant groups ($R^2$, all of $R^4$) would be 7.22 (i.e., (1+8*8)/9). This PAO molecule, which can be produced by polymerizing 1-decene using certain metallocene catalyst systems described in greater detail below, can be represented by formula (F-2) below:

(F-2)

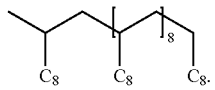

In this molecule, the longest 5%, 10%, 20%, 40%, 50%, and 100% of the pendant groups have average pendant group length of Lpg(5%) of 8, Lpg(10%) of 8, Lpg(20%) of 8, Lpg(50%) of 8, and Lpg(100%) of 7.22, respectively.

Depending on the polymerization catalyst system used, however, different degrees of isomerization of the monomers and/or oligomers can occur in the reaction system during the polymerization process, resulting in different degrees of substitution on the carbon backbone. In a specific example of such case, assuming $R^2$, $R^3$, all $R^5$ are methyls, and $R^6$ is hydrogen, $R^1$ has 8 carbon atoms in the longest straight carbon chain contained therein, and all $R^4$ and $R^7$ have 7 carbon atoms in the longest straight carbon chain contained therein, and n=8, then the carbon backbone of the (F-1) PAO molecule would comprise 34 carbon atoms, and the average pendant group length of the pendant groups ($R^2$, all $R^4$, and R5) would be 3.67 (i.e., (1+1+7*8+1*8)/18). This PAO molecule, which may be produced by polymerizing 1-decene using certain non-metallocene catalyst systems described in greater detail below, can be represented by the following formula (F-3):

(F-3)

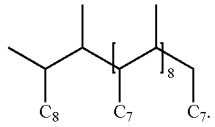

In this molecule, the longest 5%, 10%, 20%, 40%, 50%, and 100% of the pendant groups have average pendant group lengths of Lpg(5%) of 7, Lpg(10%) of 7, Lpg(20%) of 7, Lpg(50%) of 6.3, and Lpg(100%) of 3.67, respectively.

PAO base stocks useful for the present invention may be a homopolymer made from a single alpha-olefin monomer or a copolymer made from a combination of two or more alpha-olefin monomers.

Preferable PAO base stocks useful for the present invention are produced from an alpha-olefin feed comprising one or more alpha-olefin monomers having an average number of carbon atoms in the longest straight carbon chain thereof in a range from Nc1 to Nc2, where Nc1 and Nc2 can be, e.g., 6.0, 6.5, 7.0, 7.5, 8.0, 8.5, 9.0, 9.5, 10.0, 10.5, 11.0, 11.5, 12.0, 12.5, 13.0, 13.5, 14.0, 14.5, 15.0, 15.5, or 16.0, as long as Nc1<Nc2. The "alpha-olefin feed" may be continuous or batch-wise. Each of the alpha-olefin monomer may comprise from 4 to 32 carbon atoms in the longest straight carbon chain therein. Preferably, at least one of the alpha-olefin monomer is a linear alpha-olefin (LAO). Preferably, the LAO monomers have even number of carbon atoms. Non-limiting examples of the LAOs include but are not limited to 1-butene, 1-pentene, 1-hexene, 1-heptene, 1-octene, 1-nonene, 1-decene, 1-undecene, 1-dodecene, 1-tridecene, 1-tetradecene, 1-pentadecene, 1-hexadecene, 1-heptadecene, 1-octadecene, 1-nonadecene, 1-eicosene, 1-heneicosene, 1-docosene, 1-tricosene, 1-tetracosene in yet another embodiment. Preferred LAO feeds are 1-hexene, 1-octene, 1-decene, 1-dodecene, 1-tetradecene, 1-hexadecene and 1-octadecene. Preferably, the alpha-olefin feed comprises ethylene at a concentration not higher than 1.5 wt % based on the total weight of the alpha-olefin feed. Preferably, the alpha-olefin feed is essentially free of ethylene. Examples of preferred LAO mixtures as monomers for making the PAO useful in the present invention include, but are not limited to: C6/C8; C6/C10; C6/C12; C6/C14; C6/C16; C6/C8/C10; C6/C8/C12; C6/C8/C14; C6/C8/C16; C8/C10; C8/C12; C8/C14; C8/C16; C8/C10/C12; C8/C10/C14; C8/C10/C16; C10/C12; C10/C14; C10/C16; C10/C12/C14; C10/C12/C16; and the like.

During polymerization, the alpha-olefin monomer molecules react with components in or intermediates formed from the catalyst system and/or each other, resulting in the formation of covalent bonds between carbon atoms of the carbon-carbon double bonds of the monomer molecules, and eventually, an oligomer or polymer formed from multiple monomer molecules. The catalyst system may comprise a single compound or material, or multiple compounds or materials. The catalytic effect may be provided by a component in the catalyst system per se, or by an intermediary formed from reaction(s) between components in the catalyst system.

The catalyst system may be a conventional catalyst based on a Lewis acid such as $BF_3$ or $AlCl_3$, or a Friedel-Crafts catalyst. During polymerization, the carbon-carbon double bonds in some of the olefin molecules are activated by the catalytically active agent, which subsequently react with the carbon-carbon double bonds of other monomer molecules. It is known that the thus activated monomer and/or oligomers may isomerize, leading to a net effect of the shifting or migration of the carbon-carbon double bonds and the formation of multiple short-chain pendant groups, such as methyl, ethyl, propyl, and the like, on the carbon backbone of the final oligomer or polymer macromolecules. Therefore, the average pendant group length of PAOs made by using such conventional Lewis acid-based catalysts can be relatively low. In addition, the isomerization of the monomers and/or oligomers in the presence of Lewis acid can lead to the presence of pendant groups attached to adjacent carbon atoms on the carbon backbone. Furthermore, PAO oligomers and polymers made by using such conventional Lewis acid catalyst typically are atactic. FIG. 1 is an illustration of a conventional PAO (cPAO) molecule made from alpha olefins by using a Lewis acid catalyst. In this molecule, multiple methyl groups are present.

Alternatively or additionally, the catalyst system may comprise a non-metallocene Ziegler-Natta catalyst. Alternatively or additionally, the catalyst system may comprise a metal oxide supported on an inert material, e.g., chromium oxide supported on silica. Such catalyst system and use thereof in the process for making PAOs are disclosed in, e.g., U.S. Pat. No. 4,827,073 (Wu); U.S. Pat. No. 4,827,064 (Wu); U.S. Pat. No. 4,967,032 (Ho et al.); U.S. Pat. No. 4,926,004 (Pelrine et al.); and U.S. Pat. No. 4,914,254 (Pelrine), the relevant portions thereof are incorporated herein by reference in its entirety.

Figure 2:
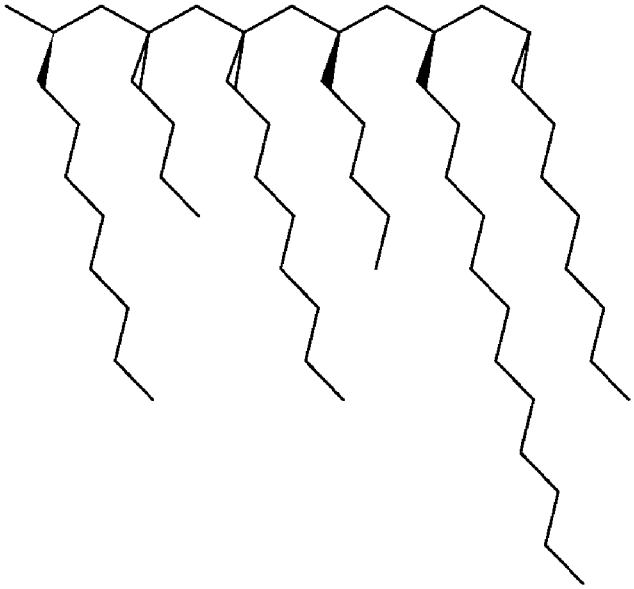
FIG. 2 is a molecular structure of a typical metallocene PAO (mPAO) made from long chain (C6 and longer) linear alpha olefins (LAO) monomers by using a metallocene catalyst system.
Figure 3:
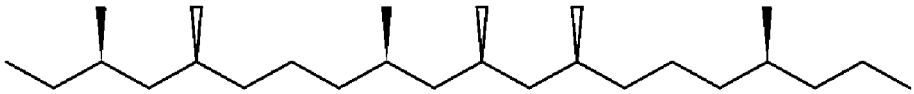
FIG. 3 is a molecular structure of a typical long backbone PAO made from ethylene and propylene by a metallocene catalyst system.

Preferably, the catalyst system comprises a metallocene compound and an activator and/or cocatalyst. Such metallocene catalyst system and method for making metallocene mPAOs using such catalyst systems are disclosed in, e.g., WO 2009/148685 A1, the content of which is incorporated herein by reference in its entirety. When metallocene catalyst systems are used, it is possible to make highly structurally regio-regular mPAO molecules. Specifically, one can make substantially isotactic or syndiotactic mPAO molecules in which pendant groups are essentially connected only to carbon atoms spaced apart by one intermediate carbon atom. Isotacticity is characterized by the presence of (mm)-triads, and syndiotacticity by the presence of (mm)-triads. FIG. 2 is an illustration of a mPAO molecule made from alpha olefins by using a metallocene catalyst, which exhibits a 100% isotactic structure, i.e., 100 mol % of (mm)-triads among all triads therein. In this molecule, there is only one methyl pendant group. Certain isotactic PAO molecules always comprise one and one only methyl pendant group, if alpha olefins having 4 or more carbon atoms on its longest carbon chain are exclusively used for the production thereof. Percentages of (mm)-triads, (a)-triads and (mr)-triads in the molecules can be determined by using measurements such as NMR, particularly $C^{13}$-NMR.

Generally, when a supported chromium oxide or metallocene-containing catalyst system is used, isomerization of the olefin monomers and/or the oligomers occurs less frequently, if at all, than when a conventional Lewis acid-based catalyst such as $AlCl_3$ or $BF_3$ is used. Therefore, the average pendant group length of PAOs made by using these catalysts (i.e., mPAOs and chromium oxide PAOs, or chPAOs), can reach or approach the theoretical maximum, i.e., where no shifting of the carbon-carbon double bonds occurs during polymerization. Therefore, in the present invention, PAO base stocks made by using metallocene catalysts or supported chromium oxide catalysts (i.e., mPAOs and chPAOs) are preferred, assuming the same monomer(s) is used.

Thus, in the present invention, the PAO base stock comprises multiple oligomeric and/or polymeric PAO molecules, which may be the same or different. Each PAO molecule comprise multiple pendant groups, which may be the same or different, and the longest 5%, 10%, 20%, 40%, 50%, and 100% of the pendant groups of all of the molecules of the PAO base stock have an average pendant group length of Lpg(5%), Lpg(10%), Lpg(20%), Lpg(40%), Lpg(50%), and Lpg(100%), respectively. It is preferred that at least one of the following conditions is met:

(i) $a1 \leq Lpg(10\%) \leq a2$, where a1 and a2 can be, independently, 7.0, 7.5, 8.0, 8.5, 9.0, 9.5, 10.0, 10.5, 11.0, 11.5, or 12.0, as long as $a1 < a2$;

(ii) $b1 \leq Lpg(10\%) \leq b2$, where b1 and b2 can be, independently, 7.0, 7.5, 8.0, 8.5, 9.0, 9.5, 10.0, 10.5, 11.0, 11.5, or 12.0, as long as $b1 < b2$;

(iii) $c1 \leq Lpg(20\%) \leq c2$, where c1 and c2 can be, independently, 6.5, 7.0, 7.5, 8.0, 8.5, 9.0, 9.5, 10.0, 10.5, or 11.0, as long as $c1 < c2$;

(iv) $d1 \leq Lpg(40\%) \leq d2$; where d1 and d2 can be, independently, 6.0, 6.5, 7.0, 7.5, 8.0, 8.5, 9.0, 9.5, 10.0, 10.5, or 11.0, as long as $d1 < d2$;

(v) $e1 \leq Lpg\ (50\%) \leq e2$; where e1 and e2 can be, independently, 5.5, 6.0, 6.5, 7.0, 7.5, 8.0, 8.5, 9.0, 9.5, or 10.0, as long as $e1 < e2$; and (vi) $f1 \leq Lpg(100\%) \leq f2$, where f1 and f2 can be, independently, 5.0, 5.5, 6.0, 6.5, 7.0, 7.5, 8.0, 8.5, 9.0, 9.5, or 10.0, as long as $f1 < f2$.

The average pendant group length of all pendant groups on each molecule, excluding one methyl group, if there is one or more methyl pendant group, is Lpg(M). It is preferred that:

(vii) $g1 \leq Lpg(M) \leq g2$, where g1 and g2 can be, independently, 5.0, 5.5, 6.0, 6.5, 7.0, 7.5, 8.0, 8.5, 9.0, 9.5, or 10.0, as long as $g1 < g2$.

Preferably, at least 60% of the pendant groups on the PAO molecules in the PAO base stock are straight chain alkyls having at least 6 carbon atoms. Preferably, at least 90% of the pendant groups on the PAO molecules in the PAO base stock are straight chain alkyls having at least 6 carbon atoms. Preferably, at least 60% of the pendant groups on the PAO molecules in the PAO base stock are straight chain alkyls having at least 8 carbon atoms. Preferably, at least 90% of the pendant groups on the PAO molecules in the PAO base stock are straight chain alkyls having at least 8 carbon atoms.

The PAO base stock useful in the present invention may have various levels of regio-regularity. For example, each PAO molecule may be substantially atactic, isotactic, or syndiotactic. The PAO base stock, however, can be a mixture of different molecules, each of which can be atactic, isotactic, or syndiotactic. Without intending to be bound by a particular theory, however, it is believed that regio-regular PAO molecules, especially the isotactic ones, due to the regular distribution of the pendant groups, especially the longer ones, tend to contribute to the highly desired EHL performance of the PAO base stock, and therefore preferred. Thus, it is preferred that at least 50%, or 60%, or 70%, or 80%, or 90%, or even 95%, by mole, of the PAO base stock molecules are regio-regular. It is further preferred that at least 50%, or 60%, or 70%, or 80%, or 90%, or even 95%, by mole, of the PAO base stock molecules are isotactic. PAO base stocks made by using metallocene catalysts can have such high regio-regularity (syndiotacticity or isotacticity), and therefore are preferred. For example, it is known that a metallocene-based catalyst system can be used to make PAO molecules with over 95%, or even substantially 100% isotacticity.

The PAO base stock useful for the present invention can have various viscosity. For example, it may have a KV100 in a range from 200 to 1000 cSt, such as 1 to 3000 cSt, 2 to 2000 cSt, 2 to 1000 cSt, 2 to 800 cSt, 2 to 600 cSt, 2 to 500 cSt, 2 to 400 cSt, 2 to 300 cSt, 2 to 200 cSt, or 5 to 100 cSt. The exact viscosity of the PAO base stock can be controlled by, e.g., monomer used, polymerization temperature, polymerization residence time, catalyst used, concentration of catalyst used, distillation and separation conditions, and mixing multiple PAO base stocks with different viscosity.

To achieve the desired level of kinematic viscosity of the base stock of the present invention, it is desired that at least 90 mol % of the PAO molecules comprise a total number of carbon atoms in the range from 300 to 800. Generally, the higher the total number of carbon atoms, the higher the average molecule average of the PAO molecules, and the higher the KV100 thereof.

For the present invention PAO base stock, it is highly desired that a majority of the pendant group on at least 90 mol % of the all of the PAO molecules are identical. This can be achieved by using one or more LAO feedstock with one of them constituting at least 50 mol % thereof, and using a metallocene catalyst. Without intending to be bound by a particular theory, it is believed such highly homogeneous pendant group length is beneficial for the overall EHL performance of the PAO base stock material.

Advantageously, the PAO base stock material of the present invention may have a polydispersity (PSD) in the range from 1.20 to 2.00. Generally, a narrow range of PSD can be achieved by using a metallocene catalyst, which can be beneficial to the shear stability, and many other important properties of the PAO base stock.

In general, it is desired that the PAO base stock used in the present invention has a bromine number in a range from Nb(PAO)1 to Nb(PAO)2, where Nb(PAO)1 and Nb(PAO)2 can be, independently, 0, 0.2, 0.4, 0.5, 0.6, 0.8, 1.0, 1.5, 2.0, 2.5, 3.0, 3.5, 4.0, 4.5, 5.0, as long as $Nb(PAO)1 < Nb(PAO)2$. To reach such a low bromine number, it may be desired that the PAO used in the present invention has been subjected to a step of hydrogenation where the PAO has been in contact with a $H_2$-containing atmosphere in the presence of a hydrogenation catalyst, such as Co, Ni, Ru, Rh, Ir, Pt, and combinations thereof, such that at least a portion of the residual carbon-carbon double bonds present on the PAO molecules are saturated.

Examples

A number of PAO base stock samples (S1-S5, and S7-S14, TABLET below) and one non-PAO sample (S6) were tested for the EHL performances at 40° C., 80° C., and 120° C. Tests were conducted pursuant to standard processes developed by Powertrib, having an address at The Oxford Science Park, Magdalen Centre, Robert Robinson Avenue, Oxford, OX4 4GA, UK ("Powertrib") by Powertrib using its EHD Ultra Thin Film Thickness Measurement System (PCS Instruments), which measures the lubricant film thickness formed between a rolling steel ball on silica-coated disk, as a function of rolling speed. Film thicknesses at 40° C., 80° C., and 120° C., measured at a velocity of 0.2 m/s, corresponding to the elastohydrodynamic regime, were measured.

The samples tested and test results are provided in TABLE I, below. In this table, cPAO stands for conventional PAOs made by using a non-metallocene catalyst, mPAO for PAOs made by using a metallocene catalyst, chPAO for PAOs made by using a chromium oxide-based catalyst, PP/PE for a polypropylene/polyethylene copolymer, non-PAO for polymer that is not pure PAO, Lpg(x %) for average pendant group length of longest x mol % of the pendant groups, Lpg(M) for average pendant group length of all pendant groups excluding one methyl group on each molecule, if there is at least one methyl group among them; and EHL for electrohydrodynamic lubrication regime.

Among the samples, S1, S2, S3, S4, S5, S6, S7, S8, S10, S11, and S12 are commercially available products in the prior art. S9 and S13 are inventive, and S14 is comparative in that it has a KV100 of less than 200. S9, S13 and S14 and isotactic mPAOs having mole percentage of (mm)-triads of at least 60% (e.g., higher than 65%, 70%, 75%, 80%, 85%, or even 90%). S13 was made by oligomerization of a monomer mixture comprising 70 wt % of 1-octene and 30 wt % of 1-dodecene, using a catalyst system comprising rac-dimethyl-silyl-bis [4,5,6,7-tetrahydroindenyl]zirconium dichloride, N,N-dimethylanilinium tetrakis(penta-fluorophenyl)borate, and tri-n-oclylaluminum, in a manner similar to the process described in Example 8, U.S. Patent Application Serial No. 2009/0247442 A1.

From TABLE I and FIGS. 4-9, it can be seen that mPAOs which have high Lpg(x %) tend to have significantly higher EHL thicknesses than cPAOs with significantly lower Lpg(x %) values at temperatures from 40 to 120° C. Further, even at similar Lpg(x %), mPAOs tend to have higher EHL thicknesses than chPAOs. In addition, mPAOs with a KV100 of at least 200 demonstrated appreciably higher EHL thicknesses than those with lower KV100.

Figure 4:
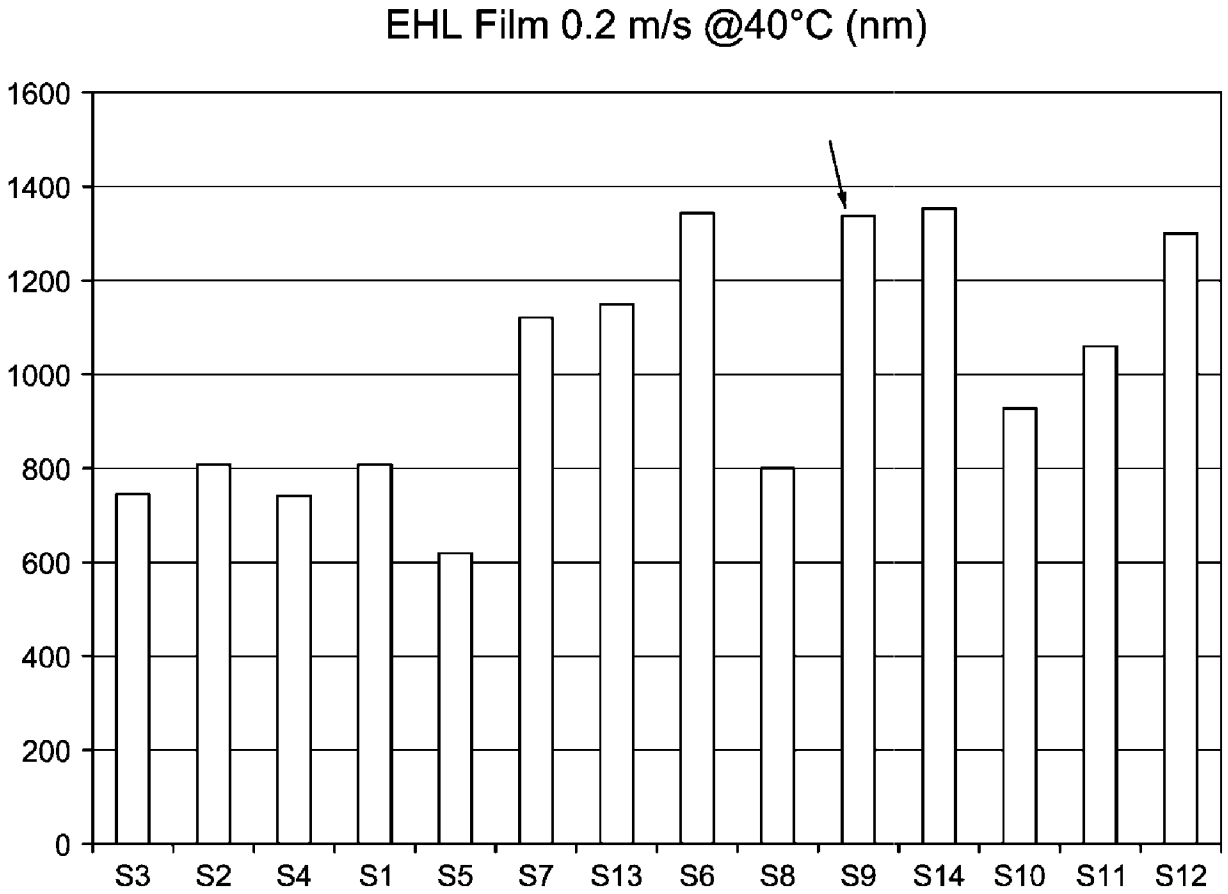
FIGS. 4 and 5 are diagrams showing EHL performance of a series of lubricant base stocks measured at 40° C. and 0.2 m/s.
Figure 5:
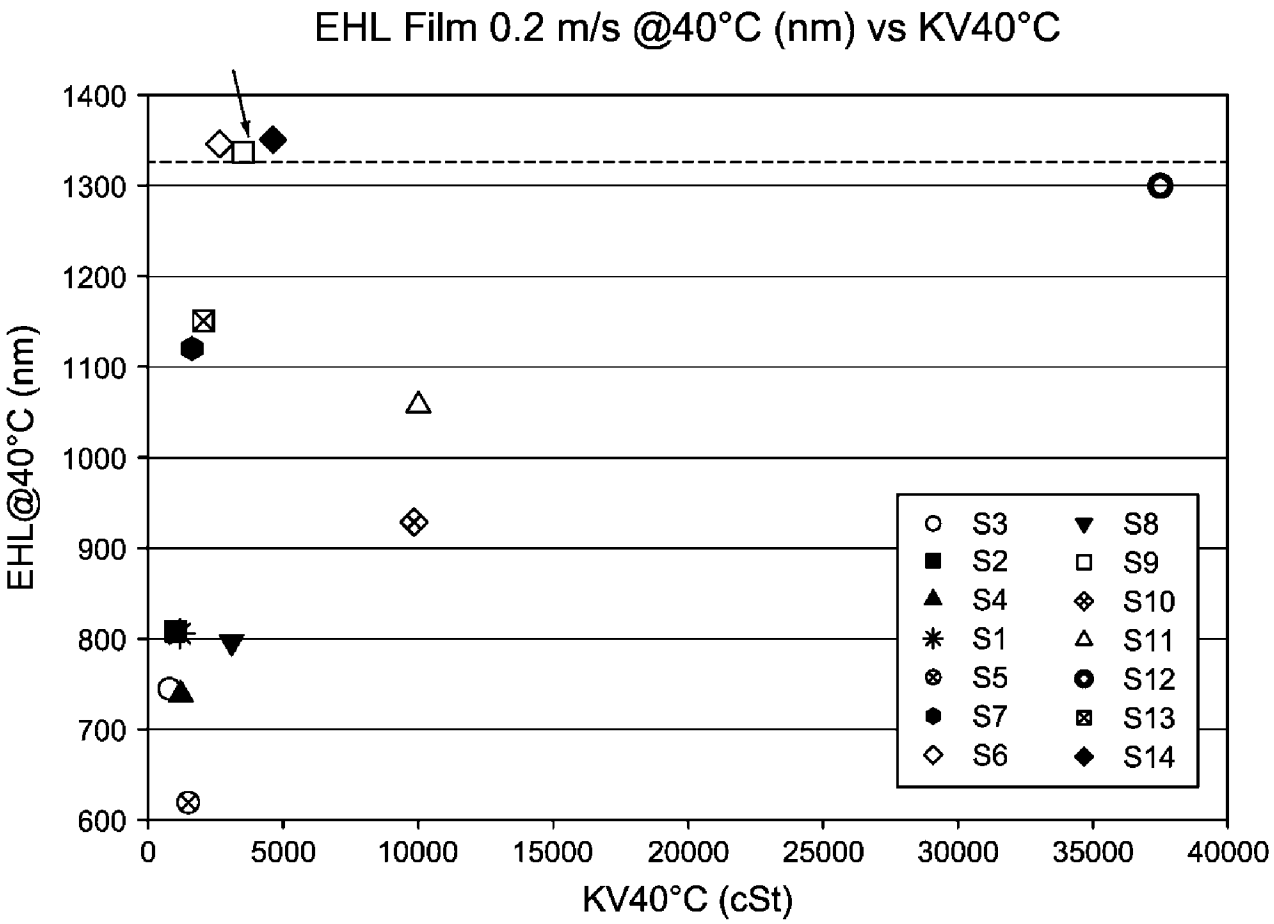

FIGS. 4 and 5 show the EHL thickness performance of the PAO samples at 40° C. when measured at 0.2 m/second. Clearly, S9, a mPAO with a KV100 of 314.3 and a Lpg(M) of about 7.3, and S14, a mPAO with a KV100 about 407 and a Lpg(M) of 6.9, have among the highest EHL thickness at this temperature. S6, a non-PAO with a Lpg(M) of about 3.0, also exhibits a high EHL thickness at this temperature. Other cPAOs have significantly lower EHL thickness at this temperature. S13, a mPAO with a KV100 of about 190 and a Lpg(M) of 6.9 as well, has appreciably lower EHL thickness at this temperature than S9 and S14. S9, S13, and S14 are all about 100 mol % isotactic in structure.

Figure 6:
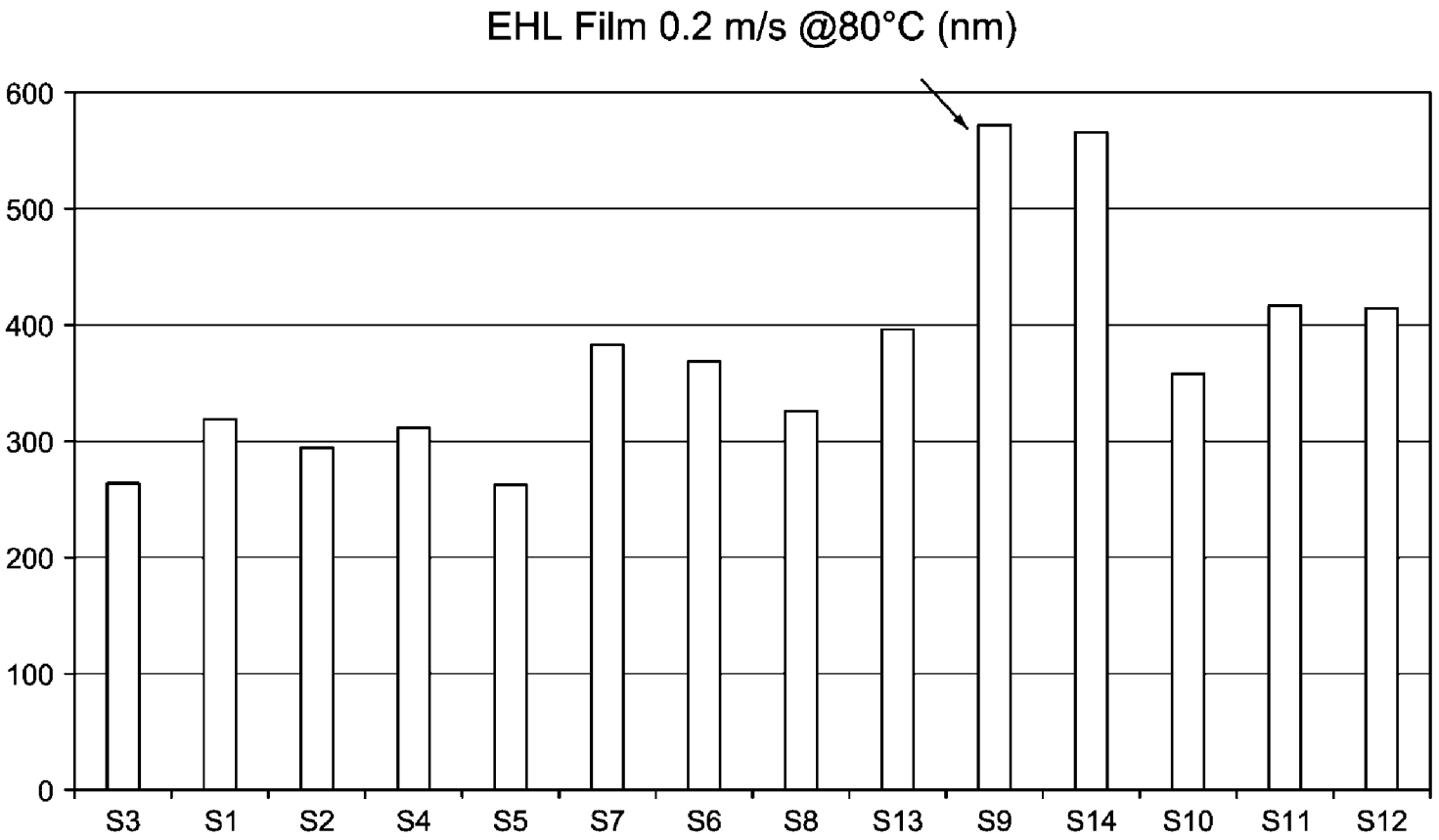
FIGS. 6 and 7 are diagrams showing EHL performance of a series of lubricant base stocks measured at 80° C. and 0.2 m/s.
Figure 7:
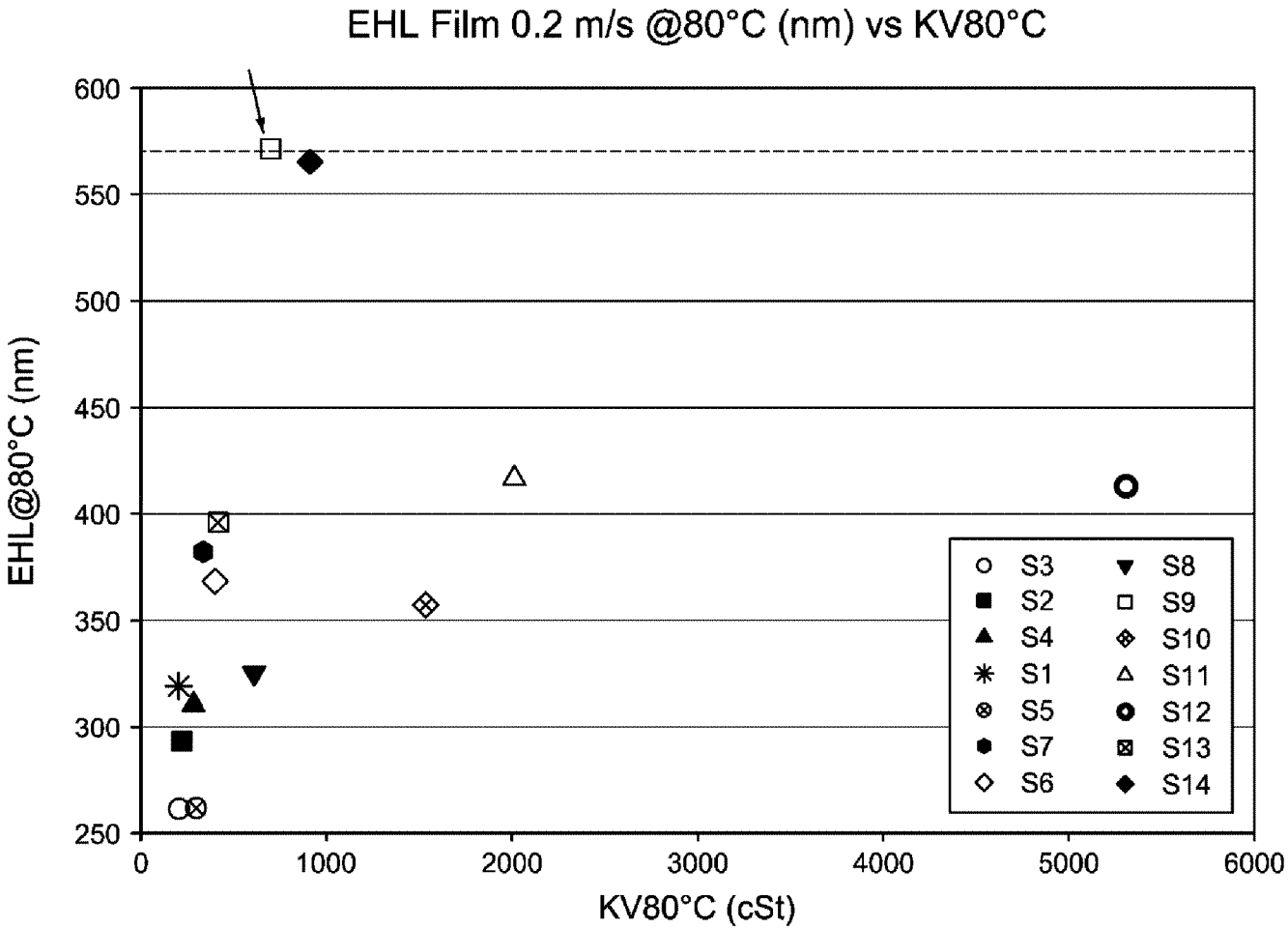

FIGS. 6 and 7 show the EHL thickness performance of the PAO samples at 80° C. when measured at 0.2 m/second. Clearly, again, S9 and S14, both mPAOs having a KV100 higher than 200 and Lpg(M) higher than 6.0, have among the highest EHL thickness at this temperature. S6, a cPAO with a Lpg(M) of about 3.0, also exhibits a high EHL thickness at this temperature. The performance of S6 reduced dramatically compared to at 40° C. Other cPAOs also have significantly lower EHL thicknesses at this temperature than S9 and S14. S13 also exhibited appreciably lower performance than S9 and S14 at this temperature.

especially those with relatively low KV100 in order to obtain a lower total KV100; (ii) additives such as antioxidants, detergents, dispersants, pour point depressants, corrosion inhibitors/metal deactivators; seal compatibility additives, anti-foam agents, inhibitors and antirust additives, viscosity modifiers, antiwear agents, and extreme pressure agents, and the like. WO 2014/046984 A1 discloses many of these additives in detail, the relevant portion thereof (pages 30-47, paragraphs [00116] to [00183], among others) are incorporated herein in their entirety.

The present disclosure includes the following non-limiting aspects and/or embodiments: A1. A PAO base stock having a KV100 of at least a1 cSt and comprising multiple PAO molecules comprising at least 200 carbon atoms per molecule, wherein the PAO molecules comprise structural units derived from C8-C20 alpha olefin monomers and are produced by using a metallocene catalyst.

A2. The PAO base stock of A1, wherein each of the multiple PAO molecules has a percentage of (mm)-triads of at least 60 mol % as determined by $C^{13}$-NMR.

B1. A lubricant composition comprising a PAO base stock of any of A1 to A2.

B2. A lubricant composition of B1, which is a gear box lubricant.

B3. A lubricant composition of B1 or B2, which is an automobile transmission lubricant.

TABLE I

| Sample | | KV40 | KV80 | KV100 | KV120 | Lpg | | | | | | Lpg | EHL Thickness (nm, @ 0.2 m/s) @ | | |
|---|---|---|---|---|---|---|---|---|---|---|---|---|---|---|---|
| No. | Type | (cSt) | (cSt) | (cSt) | (cSt) | (5%) | (10%) | (20%) | (50%) | (60%) | (100%) | (M) | 40° C. | 80° C. | 120° C. |
| S1 | cPAO | 1272 | 211 | 100.7 | 51.25 | 5 | 5 | 5 | 4.5 | 4.5 | 4 | 4.1 | 806.6 | 319 | 131.2 |
| S2 | mPAO | 1034 | 219 | 100.6 | 46.27 | 6 | 6 | 6 | 6 | 6 | 5.8 | 6 | 807.3 | 293 | 130.4 |
| S3 | mPAO | 907.9 | 209 | 100.4 | 48.2 | 8 | 8 | 8 | 8 | 8 | 7.66 | 8 | 743.9 | 262 | 113.8 |
| S4 | mPAO | 1270 | 286.5 | 136.1 | 64.65 | 8 | 8 | 8 | 8 | 8 | 7.74 | 8 | 741 | 311 | 138.9 |
| S5 | chPAO | 1500 | 304 | 150 | 91.4 | 8 | 8 | 8 | 8 | 8 | 7.75 | 8 | 618.1 | 262 | 117.7 |
| S6 | Non-PAO | 2646 | 409 | 160.7 | 63.17 | 5 | 5 | 4.5 | 4 | 3 | 3 | 3 | 1344.8 | 368.1 | 145.6 |
| S7 | mPAO | 1645 | 344 | 157.1 | 71.8 | 10 | 10 | 10 | 7.71 | 7.42 | 6.66 | 6.9 | 1119.4 | 382 | 168.2 |
| S8 | chPAO | 3100 | 615 | 300 | 181.3 | 8 | 8 | 8 | 8 | 8 | 7.79 | 8 | 796.4 | 325 | 148.2 |
| S9 | mPAO | 3547 | 705 | 314.3 | 140.1 | 10 | 10 | 10 | 8.5 | 8.08 | 7.13 | 7.3 | 1336.2 | 571 | 234.2 |
| S10 | PE/PP | 9850 | 1542 | 610.1 | 241.4 | 1 | 1 | 1 | 1 | 1 | 1 | 1 | 928.4 | 357 | 179 |
| S11 | chPAO | 10000 | 2015 | 1000 | 578 | 8 | 8 | 8 | 8 | 8 | 7.87 | 8 | 1059.8 | 416 | 188.5 |
| S12 | PE/PP | 37500 | 5312 | 2000 | 752.9 | 1 | 1 | 1 | 1 | 1 | 1 | 1 | 1300.6 | 413 | 215.7 |
| S13 | mPAO | 2084 | 422.9 | 190.5 | 85.82 | 10 | 10 | 10 | 7.71 | 7.42 | 6.66 | 6.9 | 1149.9 | 395.2 | 175.3 |
| S14 | mPAO | 4601 | 913.5 | 407 | 181.36 | 10 | 10 | 10 | 8.5 | 8.08 | 7.13 | 7.3 | 1350.1 | 564.9 | 246.1 |

Figure 8:
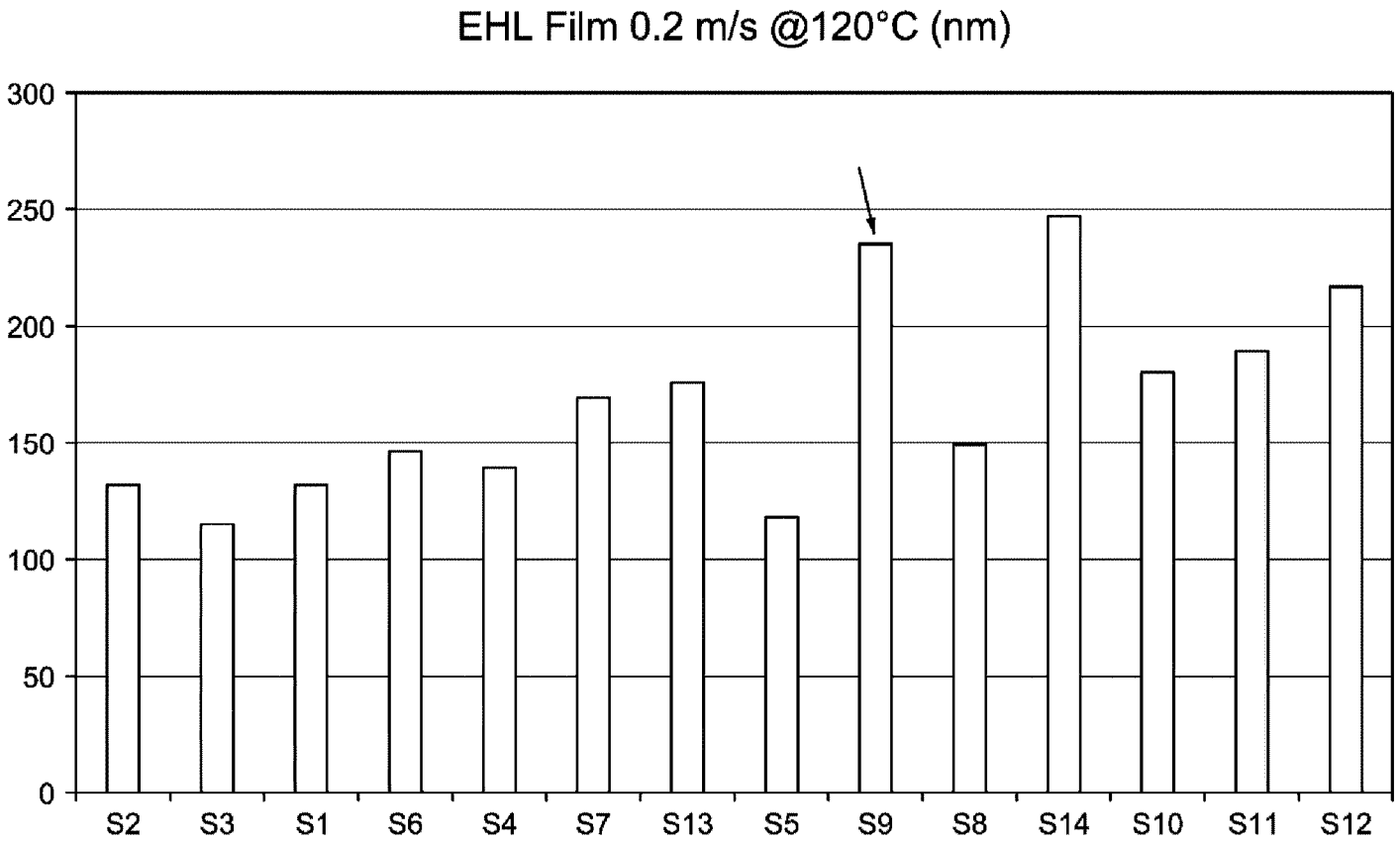
FIGS. 8 and 9 are diagrams showing EHL performance of a series of lubricant base stocks measured at 120° C. and 0.2 m/s.
Figure 9:
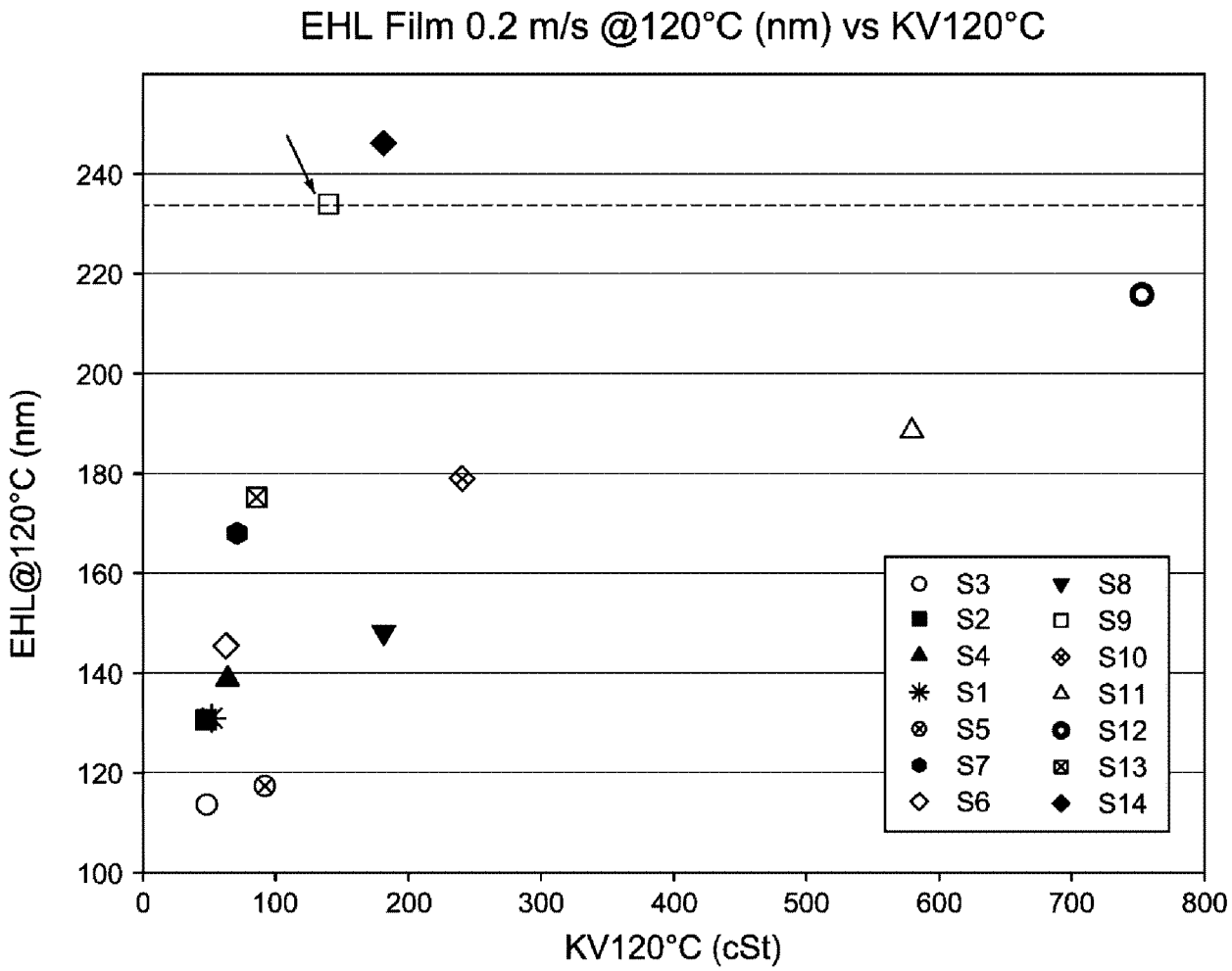

FIGS. 8 and 9 show the EHL thickness performance of the PAO samples at 120° C. when measured at 0.2 m/second. Clearly, again, S9 and S14 exhibit among the highest EHL thickness at this temperature. S6, a cPAO with a Lpg(M) of about 3.0, also exhibits a high EHL thickness at this temperature. The performance of S6 reduced dramatically compared to at 40° C. Other cPAOs also have significantly lower EHL thicknesses at this temperature than S9 and S14. S13 also exhibited appreciably lower performance than S9 and S14 at this temperature.

The high EHL performance of the PAOs according to the present invention lend them special advantages in lubricants which normally undergo high-stress events, such as: gear box oils; clutch oils; and automotive transmission oils; axle oils, drive shaft oils, traction oils, metal working fluids, hydraulic oils, and the like.

In making the lubricant formulations, the PAO base stock of the present invention may be combined with: (i) other Group I, Group II, Group III, Group IV, or Group V base stocks,

The invention claimed is:

1. A PAO base stock having a kinematic viscosity at 100° C. ("KV100") of at least 190 cSt and comprising multiple PAO molecules comprising at least 200 carbon atoms per molecule, wherein:

each of the PAO molecules comprising at least 200 carbon molecules per molecule comprises multiple pendant groups;

the average pendant group length of all the pendant groups on each PAO molecule among at least 90 mol % of all of the PAO molecules is at least 6.0, and the PAO base stock is produced by using a metallocene catalyst from a feed comprising one or more C6-C20 alpha olefins.

2. The PAO base stock of claim 1 having a KV100 of at most 600 cSt.

3. The PAO base stock of claim 1, wherein at least 90 mol % of all of the PAO molecules contained therein comprise at least 300 carbon atoms per molecule.

4. The PAO base stock of claim 1, wherein at least 90 mol % of all of the PAO molecules comprise at most 1000 carbon atoms per molecule.

5. The PAO base stock of claim 1, wherein:

in at least 90 mol % of all of the PAO molecules, at most 5 mol % of the pendant groups are bonded to adjacent carbon atoms on the main carbon chain of the respective PAO molecule.

6. The PAO base stock of claim 1, wherein:

in at least 90 mol % of all of the PAO molecules, at least 90 mol % of the pendant groups are bonded to carbon atoms on the main carbon chain of the PAO molecule that is separated by only one intermediate carbon atom from the next carbon atom to which a pendant group is attached.

7. The PAO base stock of claim 1, wherein:

in at least 90 mol % of all of the PAO molecules, there is only one methyl group among all pendant groups in each molecule.

8. The PAO base stock of claim 1, wherein:

the average pendant group length of all the pendant groups on each of the PAO molecule among at least 90 mol % of all of the PAO molecules is at least 7.0.

9. The PAO base stock of claim 1, wherein:

in at least 90 mol % of all of the PAO molecules, the mole percentage of mesotriads is at least 90%.

10. The PAO base stock of claim 1, wherein:

in at least 90 mol % of all of the PAO molecules, at least 50 mol % of the pendant groups attached to an individual PAO molecule have the same length.

11. The PAO base stock of claim 1, wherein:

in at least 90 mol % of all of the PAO molecules, at least 90 mol % of the pending groups have the same length.

12. The PAO base stock of claim 1, having a polydispersity of from 1.20 to 2.00.

13. The PAO base stock of claim 1, having a KV100 in the range from 190 to 400.

14. The PAO base stock of claim 1, wherein:

the longest 5%, 10%, 20%, 40%, 50%, and 100%, by mole, of the pendant groups of all of the molecules of the PAO base stock have an average pendant group length of Lpg(5%), Lpg(10%), Lpg(20%), Lpg(40%), Lpg(50%), and Lpg(100%), respectively; and at least one of the following conditions is met:

(i) $7.0 \leq Lpg(5\%) \leq 14.0$;

(ii) $7.0 \leq Lpg(10\%) \leq 14.0$;

(iii) $6.5 \leq Lpg(20\%) \leq 12.0$;

(iv) $6.0 \leq Lpg(40\%) \leq 12.0$;

(v) $5.5 \leq Lpg(50\%) \leq 10.0$; and (vi) $5.0 \leq Lpg(100\%) \leq 10.0$.

15. The PAO base stock of claim 1, wherein:

at least 90 mol % of all of the PAO molecules comprises from 30 to 70 pendant groups.

16. The PAO base stock of claim 1, having an EHL film thickness of at least 900 nm at 40° C. at 0.2 m/s.

17. The PAO base stock of claim 1, having an EHL film thickness of at least 360 nm at 80° C. at 0.2 m/s.

18. The PAO base stock of claim 1, having an EHL film thickness of at 160 nm at 120° C. at 0.2 m/s.

19. The PAO base stock of claim 1 having a Lpg(M) of at least 6.0, wherein Lpg(M) is the average length of the pendant groups excluding one methyl in at least 90 mol % of the PAO molecules, if one of more methyl is present on the PAO molecule.

20. The PAO base stock of claim 1 having a KV100 of at least 190 cSt and comprising multiple PAO molecules comprising at least 200 carbon atoms per molecule, wherein the PAO molecules comprise structural units derived from C8-C20 alpha olefin monomers and are produced by using a metallocene catalyst.

21. The PAO base stock of claim 20, wherein each of the multiple PAO molecules has a percentage of (mm)-triads of at least 60 mol % as determined by $C^{13}$-NMR.

22. A lubricant composition comprising a PAO base stock of claim 1.

23. A lubricant composition of claim 22, which is a gear box lubricant.

24. A lubricant composition of claim 22, which is an automobile transmission lubricant.

25. The PAO base stock of claim 1 having a KV100 of at least 200 cSt.

* * * * *